US009799984B2

(12) United States Patent
Lueckemeier

(10) Patent No.: US 9,799,984 B2
(45) Date of Patent: Oct. 24, 2017

(54) PROTECTIVE CAP FOR A PLUG CONNECTOR HOUSING

(71) Applicant: HARTING ELECTRONICS GMBH, Espelkamp (DE)

(72) Inventor: Martin Lueckemeier, Diepenau (DE)

(73) Assignee: HARTING ELECTRONICS GMBH (DE)

( * ) Notice: Subject to any disclaimer, the term of this patent is extended or adjusted under 35 U.S.C. 154(b) by 0 days.

(21) Appl. No.: 15/505,816

(22) PCT Filed: Sep. 14, 2015

(86) PCT No.: PCT/DE2015/100389

§ 371 (c)(1),
(2) Date: Feb. 22, 2017

(87) PCT Pub. No.: WO2016/041551

PCT Pub. Date: Mar. 24, 2016

(65) Prior Publication Data

US 2017/0264042 A1 Sep. 14, 2017

(30) Foreign Application Priority Data

Sep. 16, 2014 (DE) ..... 10 2014 113 324

(51) Int. Cl.
*H01R 13/44* (2006.01)
*H01R 13/52* (2006.01)
*H01R 13/443* (2006.01)

(52) U.S. Cl.
CPC ..... *H01R 13/5213* (2013.01); *H01R 13/443* (2013.01); *H01R 13/5216* (2013.01)

(58) Field of Classification Search
CPC ..... H01R 13/5213; H01R 13/5216
See application file for complete search history.

(56) References Cited

U.S. PATENT DOCUMENTS 5,202,949 A 4/1993 Hileman et al. ..... 385/134
5,704,796 A 1/1998 Swenson ..... 439/148
(Continued)

FOREIGN PATENT DOCUMENTS

DE 202011050067 8/2011 ..... H01R 13/52
DE 102012100615 7/2013 ..... G02B 6/36
WO WO2011052356 5/2011 ..... G02B 6/36

OTHER PUBLICATIONS

International Preliminary Report on Patentability issued in application No. PCT/DE2015/100389, dated Mar. 16, 2017 (7 pgs).
(Continued)

*Primary Examiner* — Xuong Chung Trans
(74) *Attorney, Agent, or Firm* — Hayes Soloway P.C.

(57) ABSTRACT

Provided is a protective cap for mounting on a plug connector housing in order to protect the plug connector housing and plug connector modules received in the plug connector housing from environmental influences such as dirt, dust and moisture. At least one receptacle in the form of a rubber nipple is provided in a plug-in side of the protective cap, which receptacle is suitable for mechanical contact-making with a plug connector module received in the plug connector housing. The mechanical connection between the protective cap and plug connector module ensures that the plug connector module is protected from damage during transport and secured against loss and falling out when the protective cap is released. Moreover, the plug connector module can be removed, together with the protective cap, from the plug connector housing.

15 Claims, 4 Drawing Sheets

(56) References Cited

U.S. PATENT DOCUMENTS

| | | | | |
|---|---|---|---|---|
| 7,217,146 | B2 * | 5/2007 | Meister | H01R 13/443 439/148 |
| 9,297,965 | B2 | 3/2016 | Schmidt et al. | G02B 6/3893 |
| 2001/0024907 | A1 | 9/2001 | Murakami et al. | 439/587 |
| 2008/0310795 | A1 | 12/2008 | Parkman, III et al. | 385/60 |

OTHER PUBLICATIONS

German Office Action (no translation) issued in application No. 10 2014 113 324.2, dated Feb. 13, 2015 (5 pgs).
International Search Report (w/translation) and Written Opinion (no translation) issued in application No. PCT/DE2015/100389, dated Nov. 16, 2015 (10 pgs).

* cited by examiner

PROTECTIVE CAP FOR A PLUG CONNECTOR HOUSING

The invention relates to a protective cap for a plug connector housing in accordance with the preamble of the independent claim 1.

Protective caps of this type are required in order to protect plug connector housings that are not connected to a mating plug connector from the influence of contaminants, dust, moisture and other environmental influences. There is a risk particularly in a harsh industrial environment or in applications in the open air that the contacts of unused plug connectors become contaminated and that contact with a mating plug connector is no longer possible. A protector of this type is necessary in particular in the case of plug connector housings for fiber optic cables or other contacts that are susceptible to contamination.

The contacts can be easily contaminated while the plug connector housings are being transported to and assembled on building sites or when said plug connector housings are outside protected areas. Contaminations of this type are particularly unfavorable in the case of contacts on fiber optic cables since a contaminated end face of the fiber optic cable would impair and interfere with the transmission of signals and in the worst case scenario would prevent the transmission of signals.

PRIOR ART

U.S. 2001/0024907 A1 discloses a dummy plug for sealing a plug-in orifice of a female plug. The dummy plug is inserted into the plug-in orifice in lieu of a male plug connector and in so doing seals said plug-in orifice.

DE 20 2011 050 067 U1 discloses a protective cap for a plug connector, wherein a thread is provided on the plug connector so as to connect the plug connector to a mating plug in a mechanical manner. The protective cap likewise comprises a thread by means of which the protective cap in lieu of the mating plug can be screwed to the plug connector. The protective cap prevents the penetration of environmental influences into the contact region of the plug connector.

Publication DE 10 2012 100 615 A1 discloses a plug connector system which comprises multiple graduated latching units that can be latched by means of a sliding mechanism. The staggered latching units, also referred to as latching steps or latching sites, render it possible to perform a level compensation between the contact means of a plug connector and a mating plug connector.

The plug connector systems known from DE 10 2012 100 615 A1 are provided for use for so-called SFP transceivers (small form-factor pluggable). The SFP transceivers are inserted into the plug connector housing—mostly a so-called attachment housing for wall ducts—and contacted by a mating plug housing which accommodates one or two mating plugs. In the case of this type of construction, the SFP transceivers are not latched in a fixed manner in the plug connector housing but rather are held by means of the latching arrangement between the plug connector housing and the mating plug housing. Only one latching arrangement between the SFP transceivers and the plug connectors of the mating plug is provided.

US 2008/310795 discloses an adaptor dust cap that comprises a plug connector for fiber optic cables, wherein said plug connector latches in the internal shape of an LWL plug connector, and a visual display.

U.S. Pat. No. 5,704,796 A represents a dummy plug for mains cable sockets, which provide evidence that the mains cable socket has been used.

WO 2011/052356 A1 discloses a protective device for optical plug connectors. The protective device is plugged onto the plug connector and seals said plug connector against external influences.

U.S. Pat. No. 5,202,949 A discloses a dust protecting means for fiber optic ferrules. Said dust protecting means also comprises a connection facility for optic fibers that are to be protected so that it is ensured that the dust protecting means is protected against becoming lost.

It follows from this that, when breaking the contact in such plug connector systems, the SFP transceiver together with the mating plug is pulled out of the plug connector housing. This is encumbered with the disadvantage that the SFP transceiver is not automatically held and secured in the plug connector. During the transportation of the plug connector, the SFP transceiver sits loosely in the plug connector and is only prevented from falling out by means of a protective cap that is intended to protect the plug connector from environmental influences.

As the protective cap is being removed, it is possible that in addition the SFP transceiver can fall out of the plug connector unintentionally and become contaminated or damaged. Likewise, the SFP transceiver can hook into or become jammed in the plug connector and thus can no longer be pulled out owing to the confined space conditions. It is also feasible that the SFP transceiver becomes damaged as a result of wobbling in the plug connector.

OBJECT OF THE INVENTION

The object of the invention resides in providing protection during transportation of SFP transceivers for use in a mentioned plug connector system. The SFP transceiver is to be protected from unintentionally falling out of a plug connector and becoming lost, and is also to be protected from becoming damaged during transportation as a result of slipping and wobbling. Likewise, it is to be possible when using the transport protection to remove the SFP transceiver from the plug connector in a simple manner without it becoming damaged or without having to use a plug connector for this purpose.

The object is achieved by means of the characterizing features of the independent claim 1.

Advantageous embodiments of the invention are disclosed in the subordinate claims.

The invention relates to a protective cap for plug connector housings that are provided for receiving plug connector modules. It is preferred that so-called attachment housings are used for plug connector housings of this type. These attachment housings are used for receptacle passageways in order for plug connector modules, preferably so-called SFP transceivers, or contacts that lie within the housing to make contact with a mating plug. The mating plug is contacted in a mechanical manner by the plug connector housing.

The protective cap forms a plug-in side and also a grip side. The grip side is provided to enable the user to grip the protective cap. An ergonomic design of the grip side renders it possible for the user to handle the protective cap more easily.

The plug-in side that lies opposite the grip side is provided so as to be able to seal a plug connector housing with respect to the environment. The plug-in side of the protective cap is embodied in such a manner that it corresponds to a mating plug that mates with the plug connector housing. In other words, the protective cap can be connected to the plug connector housing in lieu of a mating plug. The plug connector housing is sealed with respect to the environment by means of a corresponding seal.

In accordance with the invention, the plug-in side of the protective cap comprises at least one receiving device which is embodied and provided so as to contact a plug connector module in a mechanical manner. The at least one receiving device corresponds in its shape to a mating plug connector that can make contact with the plug connector module.

The receiving device in the plug-in side of the protective cap contacts the plug connector module in a mechanical manner as an alternative to the mating plug connector. In a preferred embodiment, the at least one receiving device is embodied in the form of a pin so that said pins can be inserted into the contact bushes of a plug connector module.

Corresponding to a mating plug connector, the receiving device can latch in the plug connector module with a suitable latching arrangement. In an alternative embodiment, the at least one receiving device is produced from an elastic polymer and its dimensions are slightly larger than the corresponding receiving device in the plug connector module. As a consequence, the receiving device jams in the plug connector module as it is introduced into said plug connector module and thus represents a mechanical connection between the protective cap and the plug connector module.

In a preferred embodiment, two receiving devices are provided on the plug-in side of the protective cap. These receiving devices are embodied so as to provide a mechanical contact between a plug connector module and two inputs/outputs (ports). This type of plug connector module is used above all in the case of SFP transceivers that comprise an optical input and an optical output for communication purposes.

A special embodiment provides that the plug-in side of the protective cap can be adapted for one or two receiving devices. For this purpose, a means for fastening alternatively one or two receiving devices is provided in the protective cap. The means is latched in the protective cap and comprises by way of example three orifices. It is possible to insert a receiving device centrally into the three adjacent-lying orifices or alternatively a receiving device can be inserted in each case into the two outer orifices.

As a consequence, the protective cap can be converted from being able to make contact with a plug connector module having two ports to being able to make contact with a plug connector module having only one port. This can be expedient for plug connector modules having only one, centrally-lying bi-directional port. Alternatively, the means for fastening the receiving devices can also be embodied in such a manner that it is possible to insert accordingly a different number of receiving devices.

It is possible by means of the at least one receiving device on the plug-in side of the protective cap for a plug connector module to be connected to the protective cap in a mechanical manner. It is thus no longer possible for the plug connector module to fall out or become lost as the protective cap is pulled off the plug connector housing. The plug connector module together with the protective cap is pulled off the plug connector housing and can be placed on a mating plug by the protective cap. During this procedure, the plug connector housing and the plug connector module are further protected against environmental influences.

EXEMPLARY EMBODIMENT

One exemplary embodiment of the invention is illustrated in the drawings and further explained hereinunder. In the drawings.

The figures include in part simplified, schematic illustrations. Identical reference numerals are in part used for identical but possibly non-identical elements. Different views of identical elements could be scaled differently.

Figure 1:
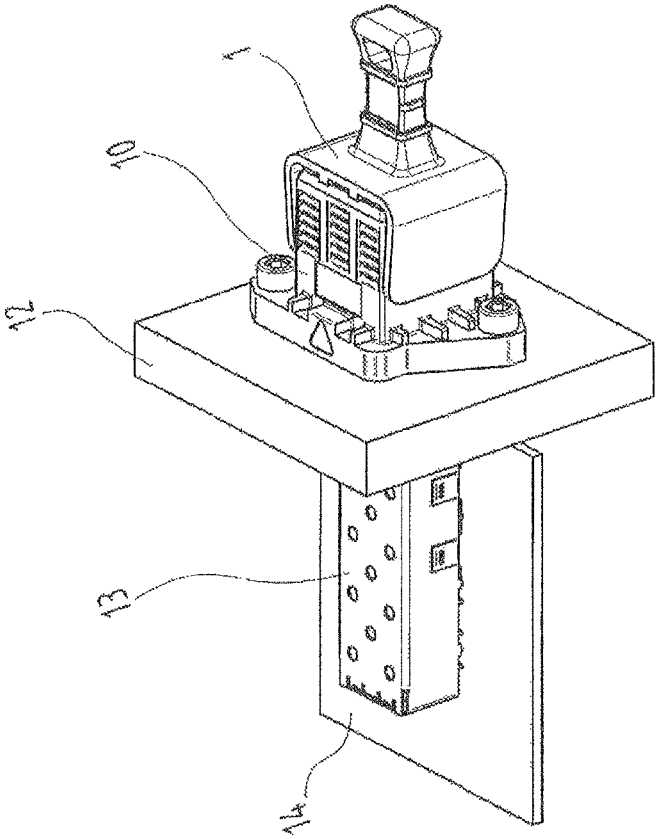
FIG. 1 illustrates a protective cap in its mounted state on a plug connector housing.

FIG. 1 illustrates a protective cap 1 that is mounted on a plug connector housing 10. The plug connector housing 10 is embodied as a so-called attachment housing and is screwed on to a housing wall 12. The housing wall 12 is illustrated in a schematic manner for the sake of simplicity.

A circuit board 14 that comprises a plug connector module receiving device, a so-called cage 13, is provided on the rear face of the housing wall 12. The cage 13 is a retainer that is embodied from sheet metal and is provided so as to receive a plug connector module. The plug connector module is inserted through the plug connector housing 10 into the cage 13.

The protective cap 1 is latched onto the plug connector housing 10 in order to protect a housing interior, in this case the rear face of the housing wall 12, from contaminants, moisture and other environmental influences.

Figure 2:
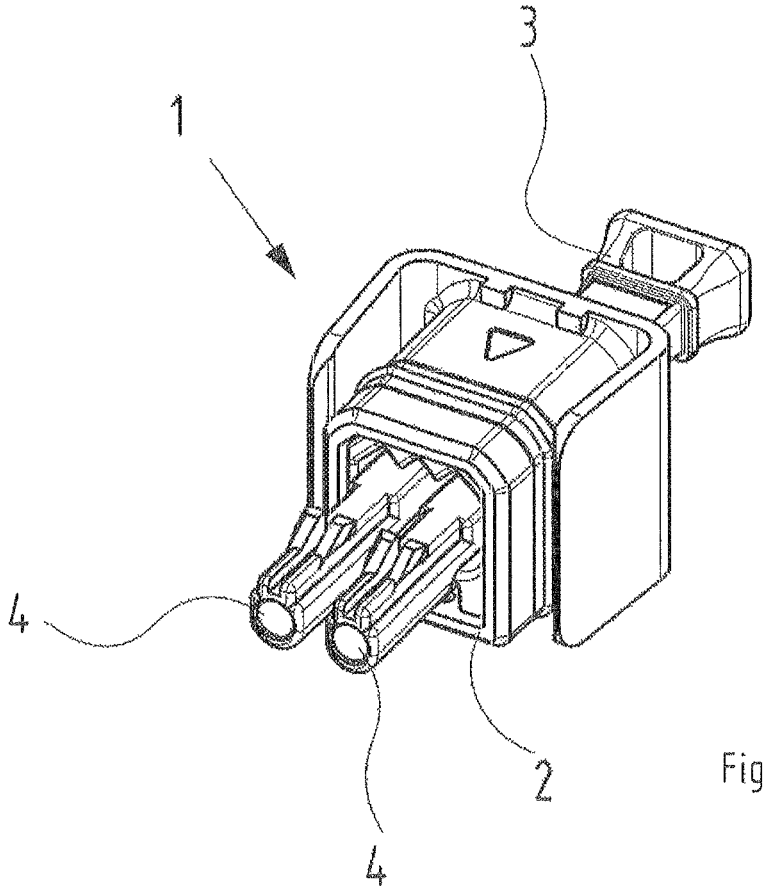
FIG. 2 illustrates a protective cap in a 3-dimensional view.

A single protective cap 1 is illustrated in the 3-dimensional view in FIG. 2. The protective cap 1 forms a plug-in side 2 in the front region, and also a grip side 3 in the rear region. The grip side 3 is provided to enable the user to grip and handle the protective cap 1. For this purpose, the grip side 3 is embodied in an ergonomic manner in order to render it possible for the user to grip said protective cover easily.

The plug-in side 2 of the protective cap 1 is embodied in such a manner as to correspond with the plug connector housing 10 in order to be able to make contact with said plug connector housing in a positive locking manner. For this purpose, the plug-in side 2 is inserted into the plug connector housing 10. A seal on the plug-in side 2 is used to provide a sealing arrangement between the protective cap 1 and the plug connector housing 10.

Two resilient arms are formed on the protective cap 1 around the plug-in side 2. The resilient arms jam the protective cap 1 on the plug connector housing 10 and hold said protective cap in a loss-proof manner.

Two receiving devices 4 are provided on the inner face of the plug-in side 2 of the protective cap 1. The receiving devices 4 extend in the plug-in direction and are provided so as to make contact with a receiving device of a plug connector module 11. The outer shape of the pin-like receiving devices 4 are embodied in such a manner as to correspond with the contact bushes of the plug connector module 11 in order to become jammed in the contact bushes. The receiving device 4 that is produced from a preferably elastic polymer and thus embodied as a rubber nipple can be connected to a plug connector module 11.

Figure 3:
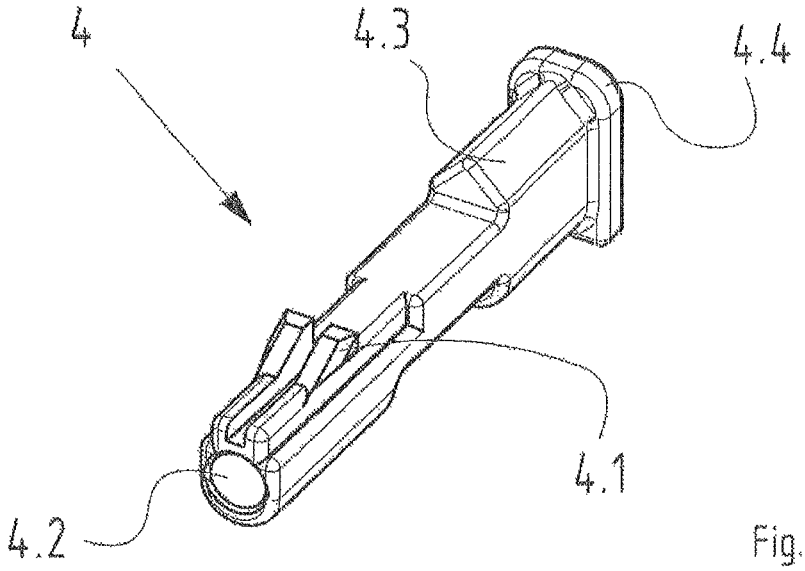
FIG. 3 illustrates an isolated receiving device.

FIG. 3 illustrates an isolated receiving device 4 in a 3-dimensional view. The receiving devices 4 can be inserted in the illustrated embodiment into the protective cap 1 in a modular manner by way of a means 5 for fastening purposes. For this purpose, the pin-shaped receiving devices 4 are formed by a front plug-in region 4.2 and a rear positioning region 4.3. The positioning region 4.3 comprises a special contour so as to be received in a non-rotatable manner in the means 5.

A flange 4.4 is provided behind the positioning region 4.3. The flange 4.4 is used as a stop for the receiving device 4 in the means 5 in order to prevent said receiving device from falling out.

The front plug-in region 4.2 is embodied so as to be received in the contact bushes of the plug connector module 11. In addition, the plug-in region 4.2 comprises latching means 4.1 which provide an additional latching and/or jamming arrangement of the plug-in regions 4.2 of the receiving devices 4 in the plug connector module 11.

Figure 4:
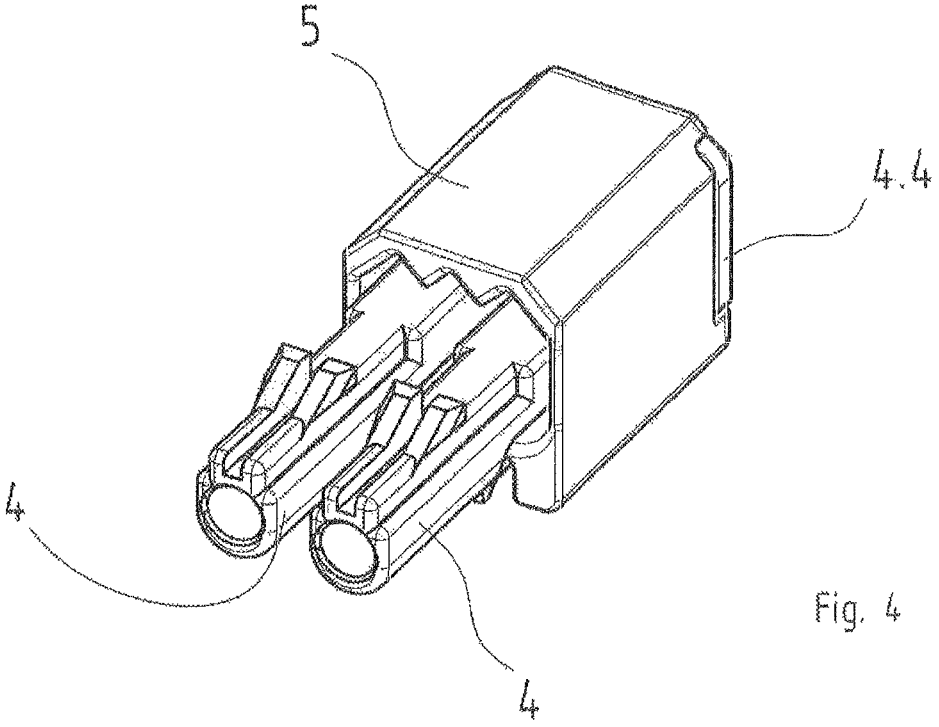
FIG. 4 illustrates a receiving module having two receiving devices.

FIG. 4 illustrates a receiving module that comprises two receiving devices 4 and a means 5 for fastening the receiving devices 4. The means 5 is embodied as an insertion piece for the plug-in side 2 of the protective cap 1. Three orifices extend through the means 5 and said orifices are provided in each case for inserting the receiving devices 4 in a positive-locking manner.

In the illustrated embodiment, two receiving devices 4 are inserted in the means 5 in each case on the right-hand and left-hand side from the rearward face. The flange 4.4 defines the insertion depth of the receiving devices 4 in the means 5 and serves as a stop so that the receiving devices 4 cannot fall out of the means 5 towards the front.

Alternatively, it is possible that only one receiving device 4 is inserted centrally into the means 5.

Figure 5:
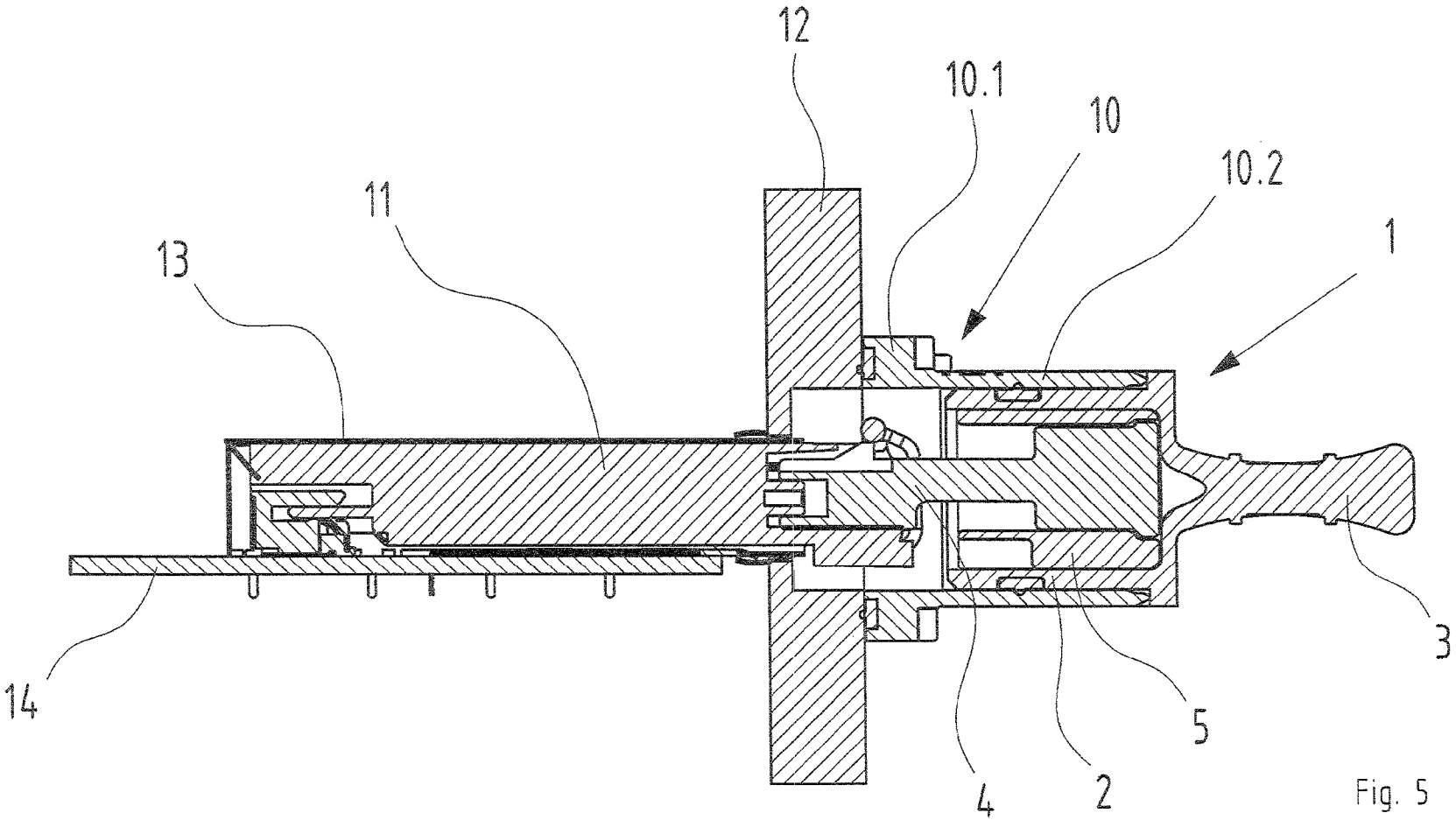
FIG. 5 illustrates a sectional view of a system comprising a plug connector housing, a plug connector module and a protective cap.

FIG. 5 illustrates a sectional view through a system comprising a plug connector housing 10, a plug connector module 11 and a protective cap 1. The figure illustrates the plug connector housing 10 that is formed from a fastening flange 10.1 and a plug receiving device 10.2. The fastening flange 10.1 is screwed onto the housing wall 12.

The plug-in side 2 of the protective cap 1 is inserted into the plug receiving device 10.2. The connection is sealed with respect to the environment by means of the sealing arrangement between the plug receiving device 10.2 and the plug-in side 2.

The means 5 is inserted into the plug-in side 2 of the protective cap 1 and fastened therein. The means 5 can be fastened both by means of a latching arrangement and also by means of a bonding arrangement or other known techniques. In turn, the means 5 supports the receiving device 4 that protrudes with its plug-in region 4.2 into the plug connector module 11. The plug connector module 11 is inserted on the rear face of the housing wall 12 into the cage 13. The cage 13 makes contact with and is fixed to the circuit board 14.

The invention claimed is:

1. A protective cap for plug connector housings that are provided for receiving plug connector modules,
wherein the protective cap forms a plug-in side, and
wherein the plug-in side is provided so as to seal a plug connector housing with respect to the environment,
wherein the plug-in side of the protective cap forms two resilient arms so as to retain a plug connector housing, wherein
the plug-in side of the protective cap comprises at least one receiving device,
that the at least one receiving device is embodied from an elastic polymer,
that the receiving device is embodied so as to contact a plug connector module in a mechanical manner and can latch with said plug connector module, and
that the plug connector module together with the protective cap is adapted to be pulled off the plug connector housing.

2. The protective cap as claimed in claim 1, wherein
the plug-in side of the protective cap comprises two receiving devices so as to contact a double plug connector module in a mechanical manner.

3. The protective cap as claimed in claim 2, wherein
the at least one receiving device is embodied in a pin-like manner and is adapted to be inserted into a contact bush of a plug connector module.

4. The protective cap as claimed in claim 2, wherein
the at least one receiving device is adapted to be latched or jammed in the contact bush of the plug connector module.

5. The protective cap as claimed in claim 2, wherein
a fastener for fastening the at least one receiving device is provided,
wherein alternatively one or two receiving devices are adapted to be inserted into the fastener.

6. The protective cap as claimed in claim 2, wherein
the protective cap comprises a grip side that lies opposite the plug-in side.

7. The protective cap as claimed in claim 1, wherein
the at least one receiving device is embodied in a pin-like manner and is adapted to be inserted into a contact bush of a plug connector module.

8. The protective cap as claimed in claim 7, wherein
the at least one receiving device is adapted to be latched or jammed in the contact bush of the plug connector module.

9. The protective cap as claimed in claim 8, wherein
a fastener for fastening the at least one receiving device is provided,
wherein alternatively one or two receiving devices are adapted to be inserted into the fastener.

10. The protective cap as claimed in claim 8, wherein
the protective cap comprises a grip side that lies opposite the plug-in side.

11. The protective cap as claimed in claim 1, wherein
the at least one receiving device is adapted to be latched or jammed in the contact bush of the plug connector module.

12. The protective cap as claimed in claim 11, wherein
a fastener for fastening the at least one receiving device is provided,
wherein alternatively one or two receiving devices is adapted to be inserted into the fastener.

13. The protective cap as claimed in claim 12, wherein
the protective cap comprises a grip side that lies opposite the plug-in side.

14. The protective cap as claimed in claim 1, wherein
a fastener for fastening the at least one receiving device is provided,
wherein alternatively one or two receiving devices are adapted to be inserted into the fastener.

15. The protective cap as claimed in claim 1, wherein
the protective cap comprises a grip side that lies opposite the plug-in side.

* * * * *